US010309269B2

(12) United States Patent
Lehmann et al.

(10) Patent No.: US 10,309,269 B2
(45) Date of Patent: Jun. 4, 2019

(54) CAMSHAFT ADJUSTING DEVICE FOR ADJUSTING A POSITION OF AT LEAST ONE CAM SEGMENT

(71) Applicant: ThyssenKrupp Presta TecCenter AG, Eschen (LI)

(72) Inventors: Martin Lehmann, Mittelndorf (DE); Michael Kunz, Chemnitz (DE)

(73) Assignees: THYSSENKRUPP PRESTA TECCENTER AG, Eschen (LI); THYSSENKRUPP AG, Essen (DE)

( * ) Notice: Subject to any disclaimer, the term of this patent is extended or adjusted under 35 U.S.C. 154(b) by 70 days.

(21) Appl. No.: 15/506,535

(22) PCT Filed: Aug. 14, 2015

(86) PCT No.: PCT/EP2015/068755
§ 371 (c)(1),
(2) Date: Feb. 24, 2017

(87) PCT Pub. No.: WO2016/030213
PCT Pub. Date: Mar. 3, 2016

(65) Prior Publication Data

US 2017/0254234 A1 Sep. 7, 2017

(30) Foreign Application Priority Data

Aug. 27, 2014 (DE) ..... 10 2014 012 496

(51) Int. Cl.
*F01L 1/344* (2006.01)
*F01L 1/047* (2006.01)

(52) U.S. Cl.
CPC ..... *F01L 1/34413* (2013.01); *F01L 1/047* (2013.01); *F01L 1/3442* (2013.01);
(Continued)

(58) Field of Classification Search
CPC ..... F01L 1/34413; F01L 1/047; F01L 1/3442; F01L 2250/02; F01L 2250/04;
(Continued)

(56) References Cited

U.S. PATENT DOCUMENTS 5,566,651 A * 10/1996 Strauss ..... F01L 1/34406 123/90.17
2009/0293826 A1 12/2009 Lancefield et al.
(Continued)

FOREIGN PATENT DOCUMENTS

DE 10 2011 087 186 A1 6/2012
DE 10 2012 105 284 A1 12/2013
(Continued)

OTHER PUBLICATIONS

Int'l Search Report for PCT/EP2015/068755 dated Oct. 14, 2015 (dated Oct. 21, 2015).
(Continued)

*Primary Examiner* — Mark A Laurenzi
*Assistant Examiner* — Wesley G Harris
(74) *Attorney, Agent, or Firm* — thyssenkrupp North America, Inc.

(57) ABSTRACT

A camshaft adjusting device of a drive, such as a motor vehicle drive, for example, for adjusting a phase position of a cam segment may include a camshaft and a phase shifter that is operatively connected to the camshaft. The camshaft may comprise a shaft segment including an inner shaft and an outer shaft at least partially surrounding the inner shaft. The camshaft adjusting device may further comprise a drive segment for driving the shaft segment and a cam segment that is connected in a form-fitting and/or force-fitting manner to the outer shaft. The phase shifter may comprise a rotor element and a stator element. A compensating element for compensating for part tolerances between the camshaft and
(Continued)

the phase shifter can be disposed at least in sections between the rotor element and the drive segment.

16 Claims, 3 Drawing Sheets

(52) U.S. Cl.
CPC ..... *F01L 2001/0473* (2013.01); *F01L 2001/0476* (2013.01); *F01L 2001/34479* (2013.01); *F01L 2250/02* (2013.01); *F01L 2250/04* (2013.01); *Y10T 74/2102* (2015.01)

(58) Field of Classification Search
CPC ..... F01L 2001/0476; F01L 2001/0473; F01L 2001/34479; Y10T 74/2102
See application file for complete search history.

(56) References Cited

U.S. PATENT DOCUMENTS

2010/0242881 A1* 9/2010 Weber ..... F01L 1/3442 123/90.17
2013/0284132 A1* 10/2013 Watanabe ..... F01L 1/34 123/90.15
2016/0326918 A1* 11/2016 Manther ..... F01L 1/34409

FOREIGN PATENT DOCUMENTS

| | | | |
|---|---|---|---|
| GB | 2 433 974 | A | 7/2007 |
| JP | H637506 | U | 5/1994 |
| JP | 868305 | A | 3/1996 |
| WO | 2011/133452 | A2 | 10/2011 |
| WO | 2012/161944 | A2 | 11/2012 |

OTHER PUBLICATIONS

English language Abstract for DE 10 2012 105 284 A1 listed above.

* cited by examiner

CAMSHAFT ADJUSTING DEVICE FOR ADJUSTING A POSITION OF AT LEAST ONE CAM SEGMENT

CROSS REFERENCE TO RELATED APPLICATIONS

This application is a U.S. National Stage Entry of International Patent Application Serial Number PCT/EP2015/068755, filed Aug. 14, 2015, which claims priority to German Patent Application No. 10 2014 012 496.7 filed Aug. 27, 2014, the entire contents of both of which are incorporated herein by reference.

FIELD

The present disclosure generally relates to camshaft adjusting devices for adjusting positions of cam segments.

BACKGROUND

It is fundamentally known that adjustable cams or cam segments in respect of their positioning on the shaft rod of a camshaft, in particular in the case of valve-controlled internal combustion engines, serve for specific influencing of the control times of the valves of the internal combustion engine in respect of the available power thereof and of the torque, wherein, for example, the fuel consumption and consequently the emission of exhaust gases can thereby also be reduced. For the adjustment or positioning of at least one cam or a cam segment, wherein a cam segment may also consist of at least two cams comprising cam contours which are oriented differently with respect to one another or are arranged with respect to one another or differ from one another, an outer shaft of the camshaft is rotated in a known manner relative to an inner shaft of the camshaft, which inner shaft is arranged coaxially with respect to the outer shaft, and vice versa, and therefore the cams which are connected rotatably to the outer shaft, but fixedly to the inner shaft, are moved relative to the cams which are connected fixedly to the outer shaft. For the adjustment or positioning of the cams or the cam segments with respect to one another, use is made, for example, of a phase shifter which permits a rotation of the inner shaft relative to the outer shaft, and therefore a phase displacement of the valve control times can be achieved or the opening duration of the valves can be varied.

Fundamentally known camshaft adjusters or phase adjusters are designed, for example, in the form of a swivel motor which is provided with a plurality of vanes in order to increase the transmittable torque. Said phase shifter, which is also referred to as swivel motor phase adjuster, is operated with engine oil pressure. Furthermore, it is fundamentally known that a phase shifter of this type is placed in the force transmission in the region of the camshaft ends and comprises drive elements which are connected directly or else indirectly to the crankshaft of the internal combustion engine and are advantageously also driven by said crankshaft. Adjusting elements of a phase shifter of this type are rotated relative to the drive elements because of a hydraulic actuation in order consequently to permit an intended phase adjustment of the camshaft relative to the crankshaft.

When the phase shifter is connected to the camshaft, in particular in the construction in which the rotor element of the phase shifter is arranged on the inner shaft of the camshaft and the stator element of the phase shifter is arranged on the outer shaft of the camshaft, component tolerances of the individual components which are connected to one another and are also operatively connected to one another, that is the inner shaft, the outer shaft, the rotor element, the stator element, etc., must be able to be compensated for in order, for example, to avoid jamming of the components and consequently an associated wear of the components and also damage to the entire camshaft adjusting device and to ensure a reliable operation of the adjustment of the cams.

WO 2011/133452 A2, for example, describes an arrangement of a flexible body which is arranged in the form of a plate between the cam adjuster and the inner shaft and outer shaft of the camshaft. However, such a flexible body extending completely over the entire connecting surface of the cam adjuster requires a large construction space, in particular in the axial direction. In addition to the use of the abovementioned flexible body, structures in respect of a double toothing or else plug-in toothing in order to be able to compensate for tolerances of the components when the phase shifter is connected to the camshaft are also known to the applicant from the general prior art. However, toothings of this type disadvantageously increase the costs of the entire construction, in particular because of the integration of an additional gearwheel. In addition, when gearwheels are used, the generally known toothing clearance should also be considered to be disadvantageous.

DETAILED DESCRIPTION

Figure 1:
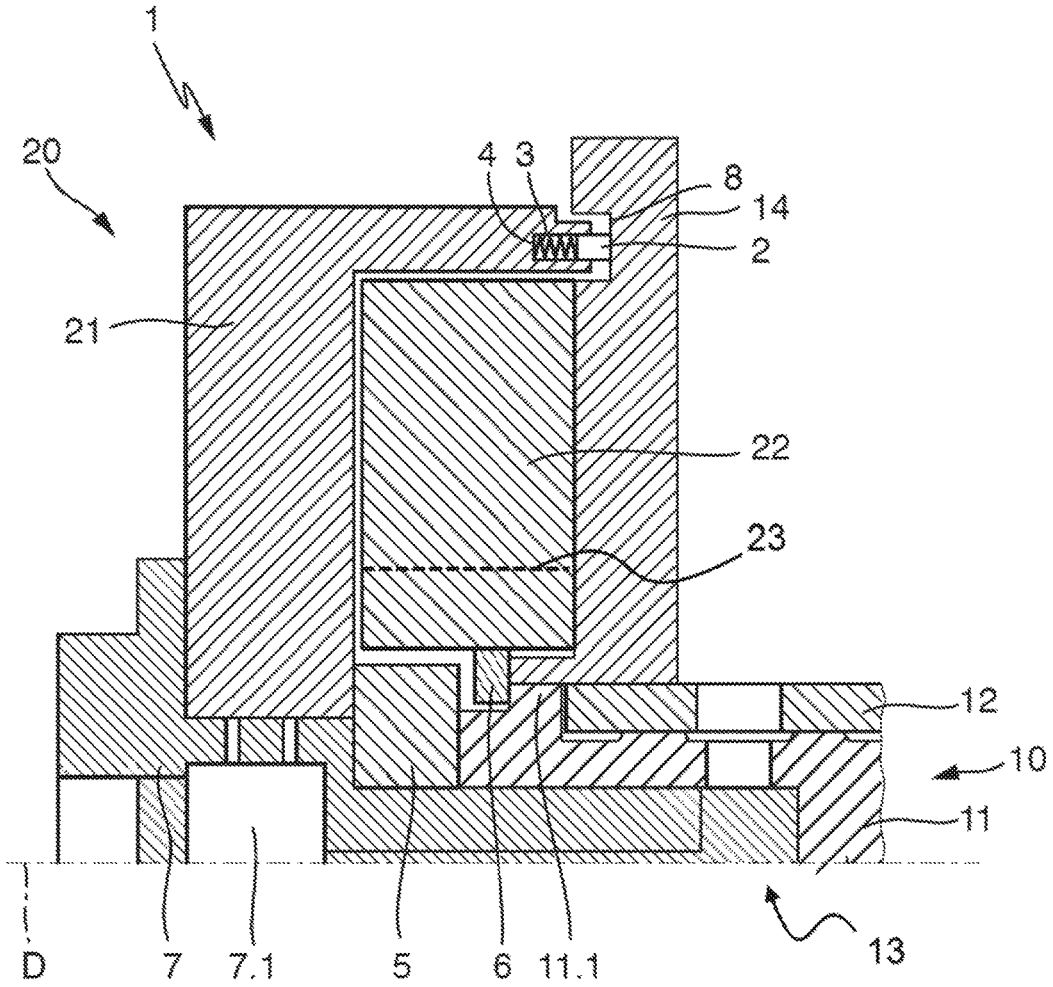
FIG. 1 is a lateral sectional view of an example camshaft adjusting device.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

One example object of the present disclosure is to at least partially eliminate the above-described disadvantages in a camshaft adjusting device. In particular, in some examples the present disclosure concerns a camshaft adjusting device which, in a simple and cost-effective manner, permits an adjustment or positioning of the at least one cam or of the at least one cam segment, wherein jamming or sliding of the components against or on one another or else too great a clearance between the individual components because of the individual component tolerances is avoided.

It is therefore the object of the present invention to at least partially eliminate the above-described disadvantages in a camshaft adjusting device. In particular, it is the object of the present invention to provide a camshaft adjusting device which, in a simple and cost-effective manner, permits an adjustment or positioning of the at least one cam or of the at least one cam segment, wherein jamming or sliding of the components against or on one another or else too great a clearance between the individual components because of the individual component tolerances is avoided.

The camshaft adjusting device according to the invention of a drive, in particular a motor vehicle drive, for adjusting a phase position of at least one cam segment comprises at least one camshaft and a phase shifter which is operatively connected to the camshaft. The camshaft itself comprises a shaft segment comprising at least one inner shaft and an outer shaft at least partially surrounding the inner shaft, and also a drive segment for driving the shaft segment, and at least one cam segment which is connected in a form-fitting and/or force-fitting manner to at least the outer shaft. The phase shifter comprises at least one rotor element and a stator element. According to the invention, a compensating element at least for compensating for component part tolerances between the camshaft and the phase shifter is arranged at least in sections between the rotor element and the drive segment.

The camshaft adjusting device consequently comprises a camshaft, the outer shaft of which is advantageously configured in the form of a tube and in particular a hollow shaft, through the through bore of which the inner shaft extends, and therefore the outer shaft and the inner shaft are arranged concentrically or coaxially with respect to each other. The inner shaft is advantageously a solid shaft. Advantageously, the inner shaft is positioned and mounted with respect to the outer shaft at least via radial bearings and/or axial bearings. Within the context of the invention, it is conceivable for the outer shaft to comprise at least one cam segment which is fixedly connected to the outer shaft, wherein at least one movable cam segment, in particular an adjusting cam segment, is arranged on the inner shaft. A cam segment is understood within the context of the present invention as meaning an individual cam or else an arrangement of at least two cams which differ with respect to one another in respect of their geometrical configuration and/or in respect of their positioning relative to the outer shaft or the inner shaft.

By means of the phase shifter, in which, according to the invention, the rotor element thereof is connected to the inner shaft and the stator element thereof is connected to the outer shaft, the inner shaft is advantageously rotated infinitely variably within a defined angular range relative to the outer shaft.

Advantageously, as a result, either the opening period of the valve elevation can be varied or the valve lift profiles and in particular the valve control time adjustment between the valves, for example the inlet valves and the outlet valves, are regulated. By this means, it is advantageously possible, for example, for the gas exchange of the internal combustion engine to be optimized and for a correspondingly variable compression ratio to be made possible by varying the inlet valve closing time in order to reduce the emission of pollutants and $CO_2$. By this means, the control of the exhaust gas after-treatment systems, such as, for example, the particle filter regeneration, and/or the control of the exhaust gas turbocharger systems are/is advantageously made possible on the basis of the variability of the outlet valves.

The drive segment is advantageously a gearwheel which is operatively connected to the outer shaft of the camshaft in order in particular to set the shaft segment of the camshaft into motion about the central axis of rotation of the shaft segment or of the camshaft. Within the context of the invention, the drive segment is connected to the outer shaft advantageously in a torsionally stiff manner, wherein said drive segment may be connected to the outer shaft in a form-fitting and/or force-fitting or else integrally bonded manner. In this connection, it is conceivable for the drive segment to be welded, pressed or soldered to the outer shaft or to be connected thereto using a correspondingly comparable joining method.

A compensating element is arranged between the drive segment and the rotor element, said compensating element serving at least to compensate for the component tolerances between the camshaft and the phase shifter, and in particular between the inner shaft and the outer shaft of the shaft segment, in order advantageously to avoid, for example, the components jamming together and accordingly to avoid damage to the components or else excessive play between the components.

Within the context of the invention, it is conceivable for the compensating element to be a sealing element, in particular a sealing ring. The sealing element advantageously comprises a rectangular cross section in order to be able to be arranged flat against a defined wall or surface of the rotor element and also against a defined wall or surface of the compensating segment in such a manner that an outlet of fluids from the region of the stator element, which means from the interior of the phase shifter and/or of the inner shaft, is advantageously also avoided. It is consequently possible for sealing which is coaxial with respect to the camshaft and/or radial with respect to the camshaft to take place by means of the compensating element, and therefore the compensating element advantageously also serves as a sealing element. However, it is also conceivable for the compensating element to comprise a cross section which is round, oval or differs geometrically with respect thereto, and therefore the shaping of the compensating element is not restricted to a defined geometry. The compensating element advantageously comprises an elastic material, such as, for example, rubber, which means, for example, natural rubber or synthetic rubber. A flexible connection of the phase shifter to the camshaft is advantageously possible on the basis of the elasticity of the compensating element. It is likewise conceivable for the compensating element to comprise at least one inelastic and advantageously stiff or rigid or material and to be configured in particular in the form of a steel element, such as, for example, in the form of a steel ring element.

Within the context of the invention, it is furthermore conceivable for the compensating element to be spring-loaded, in particular compression-spring-loaded, by means of a spring element. The spring element is advantageously a compression spring element or a compression spring which applies a spring force to at least one region of the compensating element such that the latter is pressed in the direction of the drive segment and consequently against the latter.

It is accordingly possible for the spring element to extend between the rotor element and the compensating element starting from a recess of the rotor element and to apply a compressive force on the compensating element. The recess of the rotor element is advantageously a cutout or depression in which the spring element can advantageously be positioned without slipping. As a result, the spring element at the one spring end makes contact with or touches the wall of the rotor element and in particular of the recess or cutout of the rotor element and at the other spring end makes contact with or touches the compensating element. Owing to the compressive force of the spring element, the compensating element is moved at least in the direction of the drive segment and makes contact directly therewith if no further component is positioned between the drive segment and the compensating element. By means of the spring element, a sufficient contact pressure force of the compensating element against the drive segment and in particular against a wall of the drive segment is advantageously made possible.

It is likewise conceivable for the abovementioned spring element to be arranged at least in sections in a recess or cutout of the drive segment and to extend in the direction of the rotor element. In this connection, the compensating element, which is substantially located between the spring element or the drive segment and the rotor element, is subjected to a spring force and in particular to a compression spring force in the direction of the rotor element and is consequently pressed against the rotor element.

Within the context of the invention, the stator element is surrounded at least in sections by the rotor element. The phase shifter advantageously has an inner stator element, and therefore the latter is surrounded at least in sections by the rotor element. This means that the rotor element advantageously at least in some sections surrounds the stator element, which extends radially outward starting from the camshaft, and therefore, for example, the formation of pressure spaces is made possible. By means of a corresponding design of the rotor element, a configuration of a housing covering is advantageously also at least partially made possible. Furthermore, direct contact between the compensating element and the drive segment is thereby made possible.

Furthermore, it is conceivable for the stator element to extend at least in sections between the compensating element and the drive segment. In such a configuration of the phase shifter, the compensating element consequently extends directly between the rotor element and the stator element and at least indirectly also between the rotor element and the drive segment. However, the compensating element is in direct contact here only with the stator element, in addition to with the rotor element. In this configuration, it is also conceivable for the compensating element to be spring-loaded and in particular compression-spring-loaded, as previously described.

It is likewise conceivable within the context of the invention for the inner shaft to be mounted axially by means of the phase shifter, in particular the stator element of the phase shifter. This advantageously avoids an axial bearing of the inner shaft by means of the outer shaft, in particular since said axial bearing is made possible by the stator element itself. This is structurally simple and cost-effective to realize and avoids cost-intensive geometrical configurations of the outer shaft of the camshaft. According to an advantageous embodiment, it is conceivable here for the inner shaft to have a projection which is formed geometrically in the form of a shoulder and, in the form of a bearing shoulder, fits at least in sections, for example, into a recess of the stator element, and therefore the forces acting on the inner shaft in the axial direction can be absorbed via the stator element. In the case of a correspondingly designed bearing shoulder, the forces acting in the radial direction are advantageously also absorbed starting from the inner shaft by means of the stator element.

It is furthermore possible for the inner shaft to be mounted radially by means of the phase shifter, in particular the stator element. As a result, the tolerance to be compensated for between the outer shaft and the inner shaft and the components connected thereto is advantageously reduced.

Consequently, the stator element advantageously serves as an axial and radial bearing. Accordingly, it is also conceivable for the stator element, i.e. the phase shifter, on the one side, and the drive segment, on the other side, to serve in particular for the axial mounting of the inner shaft.

It is furthermore conceivable for the camshaft adjusting device to comprise a transmission element for transmitting a torque from the rotor element to the inner shaft. Said transmission element, which may also be referred to as an intermediate element, advantageously serves for the transmission of the torque from the rotor element of the phase shifter to the inner shaft in order to permit a phase displacement of the cams or cam segments. The transmission element is designed, for example, in the form of an intermediate ring and is advantageously supported on both sides in relation to the rotor element and the inner shaft. The transmission element comprises, for example, an inelastic and advantageously non-deformable and heat- and acid-resistant material, such as metal, ceramic or plastic. It is furthermore possible for the transmission element to be able to comprise an elastic material, such as rubber.

Within the context of the invention, it is furthermore possible for the rotor element to be directly connected to the inner shaft in a form-fitting, force-fitting and/or integrally bonded manner. Accordingly, the rotor element can be connected to the inner shaft, for example by the use of an interference fit assembly, wherein it is also conceivable for the inner shaft and the rotor element to be welded, soldered or screwed to each other or connected to each other using a comparable joining method. Advantageously, when the inner shaft is directly connected to the rotor element, the use, for example, of a transmission element, as described above, is avoided. By this means, costs in the construction of the camshaft adjusting device can advantageously be reduced.

It is furthermore conceivable for the camshaft adjusting device to comprise a connecting element for connecting the rotor element to the inner shaft. Said connecting element is configured, for example, in the form of a screw element and in particular a central screw. The connecting element advantageously serves to arrange the rotor element on the inner shaft in such a manner that a transmission of the torque from the rotor element to the inner shaft is made possible. This means that the rotor element is placed on the inner shaft in such a manner that the torque can be transmitted either directly to the inner shaft, or can be transmitted to the inner shaft indirectly via a transmission element, as previously mentioned.

The connecting element is advantageously designed for permitting regulation of an oil flow. Accordingly, an individual component is used to realize a plurality of functions in a camshaft adjusting device, and therefore the latter can be produced in a simple and cost-effective manner.

It is furthermore conceivable for the rotor element to be at least one part of a housing of the camshaft adjusting device. It is possible in this connection for the housing and in particular for the cam adjusting device housing to be arranged or oriented movably relative to the stator element, wherein the drive segment itself is designed to be movable relative to the housing and in particular to be rotatable about the axis of rotation of the camshaft adjusting device. Accordingly, it is possible for the rotor element and the drive segment to together form a housing which is arranged movably relative to the stator element. An arrangement of a separate or additional housing can therefore advantageously be avoided, and therefore the production and installation costs can advantageously be reduced.

It is likewise possible for the stator element to be formed integrally with the drive segment. Consequently, the stator element and the drive segment advantageously form an individual component which can be produced and mounted in a simple and cost-effective manner. Consequently, the use of additional connecting elements is advantageously avoided.

FIG. 1 schematically shows, in a lateral sectional illustration, an embodiment of a camshaft adjusting device 1 according to the invention. The camshaft adjusting device comprises a camshaft 10 with a shaft segment 13 and at least one cam segment (not shown here) and also a phase shifter 20. The shaft segment 13 consists of an outer shaft 12 and an inner shaft 11 arranged concentrically with respect to the outer shaft 12, wherein the outer shaft 12 is configured in the form of a hollow shaft, while the inner shaft 11 is configured at least in sections as a solid shaft.

The phase shifter 20 shown in FIG. 1 comprises a rotor element 21 and a stator element 22, wherein the rotor element 21 is the driving element which applies a torque to the camshaft 10 and in particular to the inner shaft 11 of the shaft segment 12 of the camshaft 10. The stator element 22 is an inner element, as viewed with respect to the entirety of the phase shifter 20, which is virtually completely and advantageously fully circumferentially surrounded by the rotor element 21. Consequently, the rotor element 21 forms at least one part of a housing and in particular of a phase shifter housing.

Furthermore, FIG. 1 shows a drive segment 14 which is connected to the outer shaft 12 in order to drive the camshaft 10 or to set same into a rotational movement about its axis of rotation D. The drive segment 14 is advantageously configured in the form of a gearwheel, a belt wheel or else a chain wheel which interacts, for example, with a second gearwheel, belt element or else chain element (not shown here), and therefore, by the movement of a crankshaft (not shown here) via a corresponding element interacting with the drive segment, the camshaft 10 is also set into a rotational movement about its axis of rotation D.

As illustrated in the embodiment of FIG. 1, a compensating element 2 extends between the drive segment 14 and the rotor element 21, in particular in order to permit the component tolerances to be compensated for because of a flexible connection of the phase shifter 20 to the camshaft 10. The compensating element 2 is advantageously spring-loaded. This means that a spring element 3, which is advantageously a compression spring element, applies a defined compressive force to the compensating element 2 such that the compensating element 2 is pressed at least in sections against a wall of the drive segment 14. The spring element 3 is advantageously introduced at least in sections into a recess 4 of the rotor element 21, as a result of which slipping of the spring element 3 is avoided. The spring element 3 consequently extends starting from the recess 4 in the direction of the compensating element 2 which, accordingly, is arranged at the opening of the recess 4. It is furthermore conceivable for the drive segment 14 to comprise a cutout 8 which extends in the form of a material cutout starting from a surface of the drive segment 14 into the material thickness of the drive segment 14. For example, a portion of the rotor element 21, in particular that portion of the rotor element 21 on which the compensating element 2 is arranged, engages in said cutout 8. By means of the geometrical configuration of steps or supporting regions in the end region of the rotor element 21, a radial mounting between the rotor element 21 and the drive segment 14 is advantageously also made possible.

Furthermore, FIG. 1 shows a transmission element 5 which serves to transmit the torque generated by the rotor element 21 to the inner shaft 11 or to set the inner shaft 11 into a rotational movement or rotation about its axis of rotation D. The transmission element 5 consequently serves as an intermediate element between the rotor element 21 and the inner shaft 11. A connecting element 7 which is shown in FIG. 1 and comprises a valve 7.1 advantageously serves for the connection of the phase shifter 20 to the camshaft 10. Accordingly, in particular the rotor element 21 is arranged so as to make contact with the transmission element 5 by means of the connecting element 7, and therefore, on that side of the transmission element 5 which lies opposite the side which the rotor element 21 makes contact with, a contact connection with the inner shaft 11 is made possible.

The bearing element or axial bearing element 6 is, as shown in FIG. 1, arranged between the inner shaft 11 and the stator element 22 in order to permit a mounting of the inner shaft 11 relative to the phase shifter 20 and in particular relative to the stator element 22 in the axial direction. For this purpose, the inner shaft 11 comprises a shoulder 11.1 or a bearing shoulder 11.1 with which the inner shaft 11 makes contact with the axial bearing element 6. Owing to the use of the axial bearing element 6, an axial mounting of the inner shaft 11 is advantageously avoided by means of corresponding geometrical configurations of the outer shaft 12, and therefore the shaft segment 13 can be constructed in a simple manner and can be produced cost-effectively.

The dashed line in FIG. 1, identified by the reference sign 23, clarifies the arrangement of a vane element of the rotor element concealed by the section here. The dimensions and/or the geometrical configuration of said vane element 23 are advantageously defined by the geometrical configuration, dimensions and/or composition of the compensating element and consequently of the sealing edge, which is to be sealed by the latter, in the region of the rotor element or of the drive segment, in order in particular to avoid a hydraulic short circuit.

Figure 2:
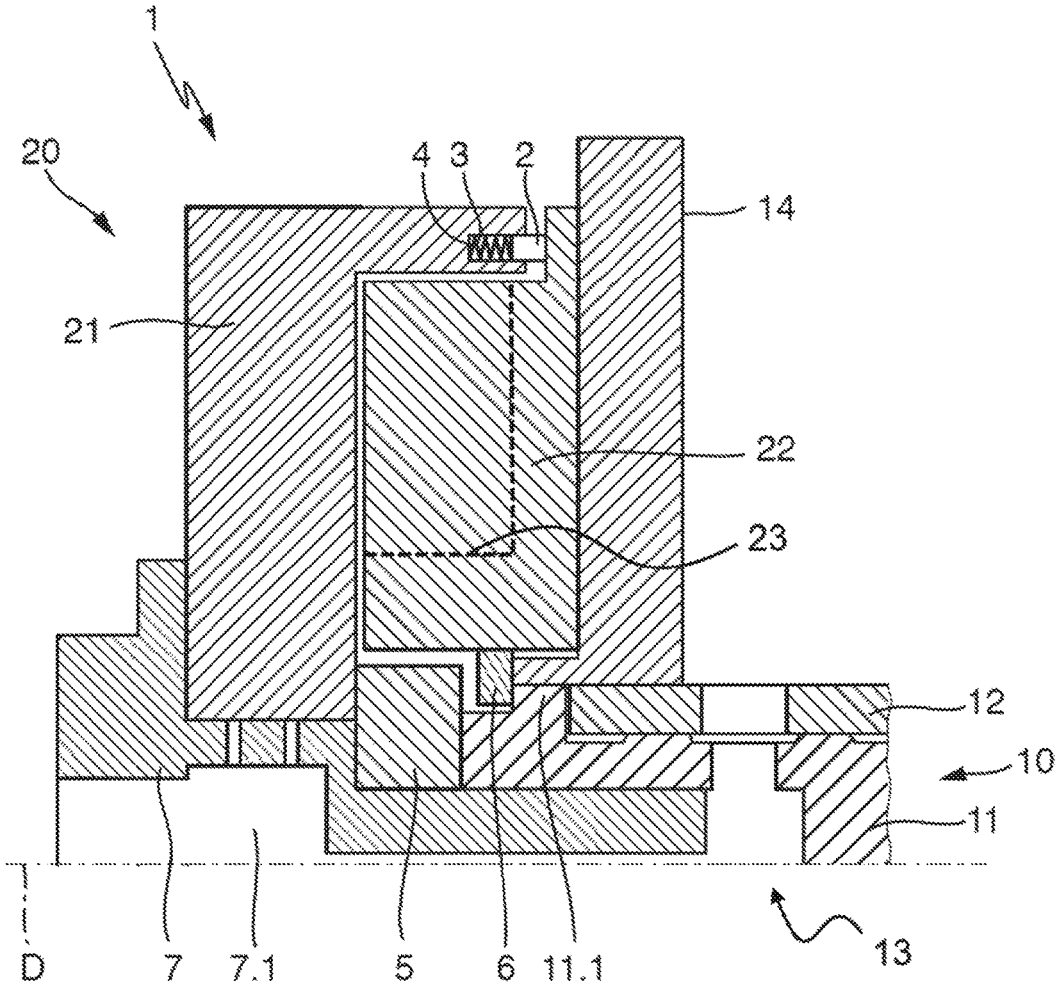
FIG. 2 is a lateral sectional view of another example camshaft adjusting device.

FIG. 2 shows a further embodiment of the camshaft adjusting device 1 according to the invention which substantially comprises the components mentioned in FIG. 1, and therefore the description previously cited with regard to FIG. 1 can be used virtually completely here. The embodiment, shown in FIG. 2, of a camshaft adjusting device 1 according to the invention differs from the embodiment, shown in FIG. 1, of a camshaft adjusting device 1 according to the invention to the extent that the stator element 22, as viewed in the axial direction, is no longer fully circumferentially surrounded or enclosed by the rotor element 21. In this connection, it is conceivable for the rotor element 21 to comprise a portion which has smaller dimensions in comparison to the embodiment in FIG. 1 and extends in the axial direction. Consequently, a distance or clearance is formed between the rotor element 21 and the drive segment 14. Accordingly, it is possible for at least one portion of the stator element 22 to extend at least in sections between the rotor element 21 and the drive segment 14, in particular between the compensating element 2 and the drive segment 14. Accordingly, the compensating element 2 is pressed against a wall of the stator element 22 by means of the spring element 3. Consequently, the configuration of the camshaft adjusting device 1 is advantageously not restricted to a stator element 22 merely located on the inside, and therefore use may also be made of differently configured stator elements 22 of the phase shifter 1, wherein compensation of component tolerances, as described above, can furthermore be realized. As already mentioned with regard to FIG. 1, FIG. 2 also shows the arrangement of a vane element 23 (not visible in the section here) of the rotor element by means of a dashed line.

Figure 3:
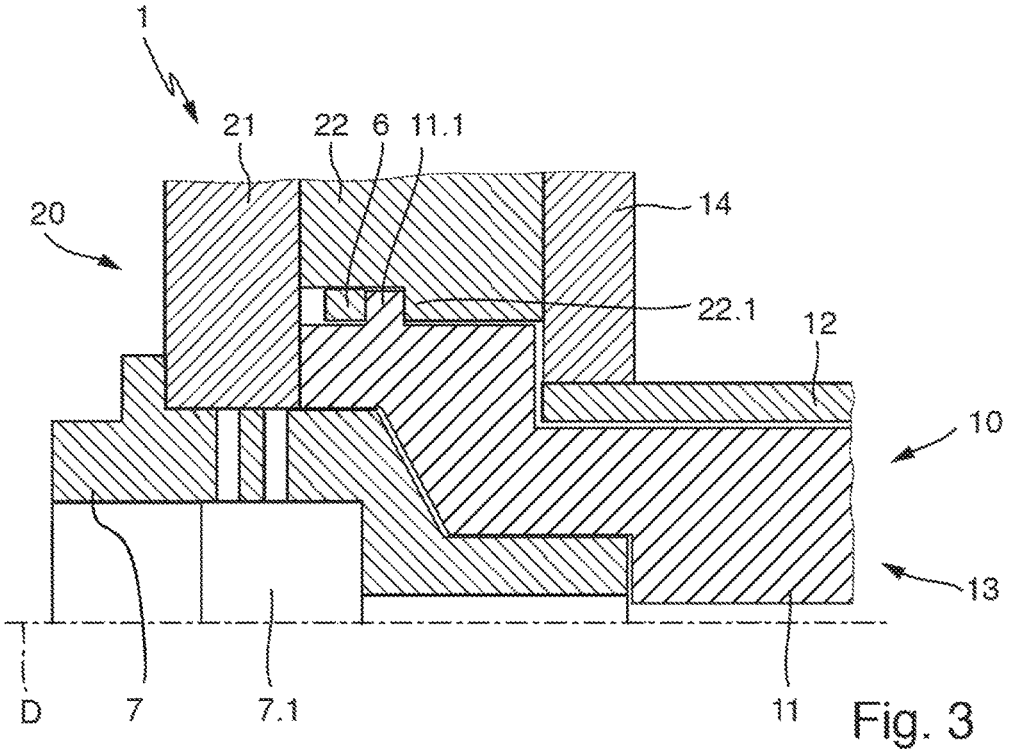
FIG. 3 is a lateral sectional view of still another example camshaft adjusting device.

FIG. 3 shows a third embodiment of a camshaft adjusting device 1 according to the invention which comprises components which are substantially comparable or else identical to the embodiments shown in FIGS. 1 and 2, and therefore the description specified for FIGS. 1 and 2 mentioned above can likewise be used for the explanation of FIG. 3. A substantial difference over the embodiments, which are shown in FIGS. 1 and 2, of a camshaft adjusting device according to the invention consists in that the embodiment shown in FIG. 3 does not comprise any transmission element. On the contrary, according to the embodiment of FIG. 3, the torque introduced by the rotor element 21 is transmitted directly to the inner shaft 11 without having to be transmitted by means of a transmission element 5 arranged between rotor element 21 and inner shaft 11 (cf. FIGS. 1 and 2). The saving on the transmission element advantageously permits the construction of the camshaft adjusting device 1 in a simpler and more cost-effective manner.

Furthermore, it can be gathered from FIG. 3 that the inner shaft 11 can also be mounted radially and/or axially independently of the outer shaft 12. For this purpose, for example, use is made of a corresponding projection 22.1 of the stator element 22. Consequently, it is possible for a wall of a bearing shoulder 11.1 of the inner shaft 11 to make contact with a wall of the projection 22.1, wherein the two walls extend substantially parallel to each other in a radial direction starting from the central axis of rotation D. The wall lying opposite that wall of the bearing shoulder 11.1 which makes contact with the projection wall then primarily makes contact with an axial bearing element 6. Owing to the contact connection of the two walls, which extend in the radial direction, of the inner shaft 11 and in particular of the bearing shoulder of the inner shaft 11, axial mounting of the inner shaft 11 relative to the phase shifter 20 is made possible. On the basis of a contact connection of an end wall of the bearing shoulder 11.1 of the inner shaft 11 with a corresponding wall or surface of the stator element 22, a radial mounting of the inner shaft 11 relative to the phase shifter 20 is advantageously made possible. The end wall of the bearing shoulder 11.1 is advantageously a wall which extends in the axial direction and is bounded by side walls correspondingly extending in the radial direction.

Figure 4:
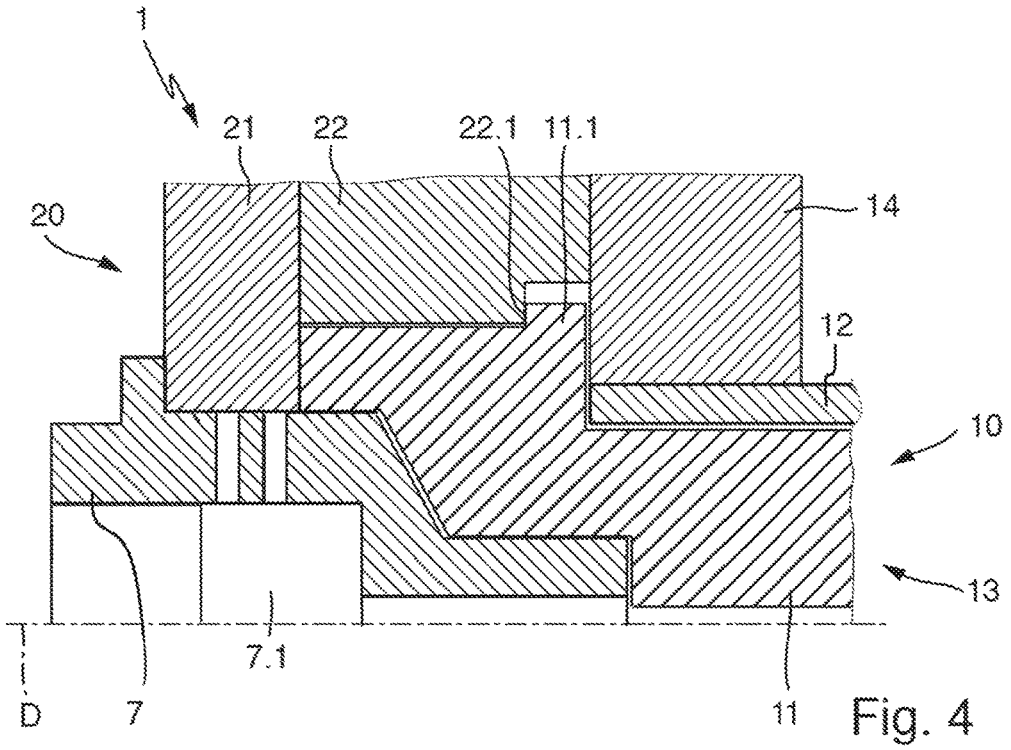
FIG. 4 is a lateral sectional view of yet another example camshaft adjusting device.

FIG. 4 shows a fourth embodiment of the camshaft adjusting device 1 according to the invention, wherein this embodiment also comprises components which are substantially comparable to the embodiments, illustrated in FIGS. 1 to 3, of a camshaft adjusting device 1 according to the invention, and therefore reference is or can be made here to the explanations regarding these embodiments shown in FIGS. 1 to 3. The embodiment, which is shown in FIG. 4, of a camshaft adjusting device 1 differs from the abovementioned embodiments in particular to the effect that there is neither a transmission element nor an axial bearing element. This advantageously saves on fitting additional components and permits the production of a cost-effective camshaft adjusting device. The axial mounting of the inner shaft 11 advantageously takes place via a bearing shoulder 11.1 of the inner shaft 11. Said bearing shoulder 11.1 firstly makes contact with a corresponding recess or wall of a projection 22.1 of the stator element 22 of the phase shifter 20 and secondly with the drive segment 14 and in particular with a wall of the drive segment 14. Consequently, the bearing shoulder 11.1 of the inner shaft 11 is arranged between the stator element 22 and the drive segment 14 at least with little movement, and therefore a movement of the bearing shoulder 11.1 and consequently of the inner shaft 11 in the axial direction, that is to say in the direction along the axis of rotation D, is avoided.

The abovementioned embodiments of a camshaft adjusting device according to the invention should be understood merely by way of example and do not establish any completeness. Consequently, further configurations, not mentioned here, of the camshaft adjusting device and in particular of the individual components thereof that are not explicitly mentioned are conceivable. In addition, this also relates to the mounting of the inner shaft in the radial direction and also in the axial direction and also to the configuration of the stator element and/or of the rotor element and/or also of the drive segment and/or the arrangement or geometrical configuration of the compensating element.

LIST OF REFERENCE SIGNS

1 Camshaft adjusting device
2 Compensating element
3 Spring element
4 Recess
5 Transmission element
6 Axial bearing element
7 Connecting element
7.1 Valve
8 Cutout
10 Camshaft
11 Inner shaft
11.1 Bearing shoulder
12 Outer shaft
13 Shaft segment
14 Drive segment
20 Phase shifter
21 Rotor element
22.1 Projection
22 Stator element
23 Vane element
D Axis of rotation

What is claimed is:

1. A camshaft adjusting device of a drive for adjusting a phase position of a cam segment, the camshaft adjusting device comprising:

a camshaft that comprises a shaft having an inner shaft and an outer shaft that at least partially surrounds the inner shaft;

a phase shifter that is operatively connected to the camshaft, the phase shifter comprising a rotor element and a stator element;

a drive segment for driving the shaft; and a sealing ring configured to compensate for component part tolerances, the sealing ring disposed at least in sections between the rotor element and the drive segment, wherein the sealing ring is spring-loaded by a spring element.

2. The camshaft adjusting device of claim 1 wherein the sealing ring is compression-spring-loaded by the spring element.

3. The camshaft adjusting device of claim 2 wherein the spring element extends between the rotor element and the sealing ring starting from a recess of the rotor element, wherein the spring element applies a compressive force to the sealing ring.

4. The camshaft adjusting device of claim 1 wherein the stator element is at least partially surrounded by the rotor element.

5. The camshaft adjusting device of claim 1 wherein the stator element extends at least in sections between the sealing ring and the drive segment.

6. The camshaft adjusting device of claim 1 wherein the inner shaft is mounted axially by way of the phase shifter.

7. The camshaft adjusting device of claim 1 wherein the inner shaft is mounted axially by way of the stator element of the phase shifter.

8. The camshaft adjusting device of claim 1 wherein the inner shaft is mounted radially by way of the phase shifter.

9. The camshaft adjusting device of claim 1 wherein the inner shaft is mounted radially by way of the stator element of the phase shifter.

10. The camshaft adjusting device of claim 1 further comprising a transmission element for transmitting a torque from the rotor element to the inner shaft.

11. The camshaft adjusting device of claim 1 wherein the rotor element is connected directly to the inner shaft in a form-fitting manner, a force-fitting manner, and/or an integrally bonded manner.

12. The camshaft adjusting device of claim 1 further comprising a connecting element for connecting the rotor element to the inner shaft.

13. The camshaft adjusting device of claim 12 wherein the connecting element is configured to regulate oil flow.

14. The camshaft adjusting device of claim 1 further comprising a housing, wherein the rotor element is at least one part of the housing.

15. The camshaft adjusting device of claim 1 wherein the stator element is integral with the drive segment.

16. A camshaft adjusting device comprising:

a camshaft that comprises a shaft having an inner shaft and an outer shaft that at least partially surrounds the inner shaft;

a phase shifter that is operatively connected to the camshaft, the phase shifter comprising a rotor element;

a drive segment for driving the shaft, and;

a sealing ring configured to compensate for part tolerances, the sealing ring disposed at least in sections between the rotor element and the drive segment, wherein the sealing ring is spring-loaded by a spring element.

* * * * *